US005507230A

United States Patent [19]

Lewis et al.

[11] Patent Number: 5,507,230

[45] Date of Patent: Apr. 16, 1996

[54] SELF-POWERED DELAYED ORDNANCE

[75] Inventors: Donald J. Lewis, Scottsdale; Larry LaClair, Mayer, both of Ariz.

[73] Assignee: Universal Propulsion Company, Inc., Phoenix, Ariz.

[21] Appl. No.: 143,255

[22] Filed: Oct. 22, 1993

[51] Int. Cl.[6] ..... F42C 11/06

[52] U.S. Cl. ..... 102/218

[58] Field of Search ..... 102/206, 200, 102/202.2, 218, 215; 361/251

[56] References Cited

U.S. PATENT DOCUMENTS

| | | | |
|---|---|---|---|
| 4,445,435 | 5/1984 | Oswald | 102/206 |
| 5,243,911 | 9/1993 | Dow et al. | 102/202.3 |
| 5,377,592 | 1/1995 | Rode et al. | 102/206 |

*Primary Examiner*—Daniel T. Pihulic
*Attorney, Agent, or Firm*—Ellsworth R. Roston; Charles H. Schwartz

[57] ABSTRACT

An input electrical pulse as from an input mechanism is rectified and converted to a direct voltage, which may be regulated in magnitude. The regulated direct voltage may be introduced to a timing circuit which produces a signal after an adjustable and pre-selected delay. This signal causes a circuit to produce a triggering signal. The circuit is biased by a capacitor charged by the direct voltage so that it produces the triggering signal only after the timing circuit has provided the pre-selected delay. The triggering signal closes a switch (e.g. makes a transistor conductive) which provides a low impedance to a firing device such as a squib. The direct voltage then activates the firing device and the firing device actuates an output mechanism. The input mechanism may be coupled to a housing at one position in the housing. When actuated, the input mechanism introduces the input pulse to the circuitry described above, such circuitry being disposed in the housing. The firing device then actuates the output mechanism, which is coupled to the housing at a second position in the housing, such second position preferably being oppositely disposed from the first position. The housing may be constructed to prevent radio frequency signals external to the housing from interfering with the operation of the circuitry in the housing.

22 Claims, 1 Drawing Sheet

SELF-POWERED DELAYED ORDNANCE

Figure 1:
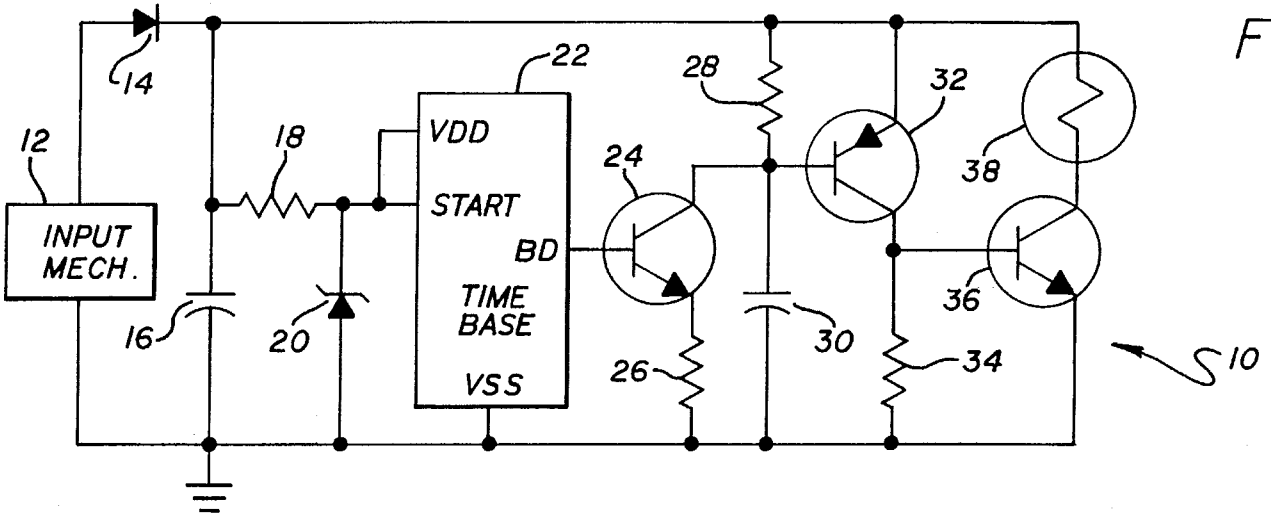

This invention relates to apparatus for actuating an output mechanism after an adjustable and pre-selected delay from the time that an input mechanism is actuated to produce an input pulse. The invention particularly relates to apparatus for utilizing the energy of the pulse from the input mechanism to actuate the output mechanism.

Ordnance systems generally have three (3) separate units: (1) an input mechanism for initiating a timing operation representing a pre-selected delay, (2) a timing system for providing the pre-selected delay and for firing a firing device (3) an output mechanism actuated by the firing device in the timing mechanism after the preselected delay. The input mechanism may take any one (1) of several different forms, all known in the prior art. For example, the input unit may provide an electrical input such as from an electrical current, an electrical signal based upon the attainment of a particular temperature or an electrical signal based upon a particular pressure.

The timing systems in the prior art have generally been pyrotechnic. For example, a material has been tombusted for a variable period of time dependent upon the characteristics of the combustible material. Such timing systems have had certain inherent disadvantages. For example, the timing has not been very accurate. Furthermore, the time delay provided by combustible materials has not been very long. The timing unit has also been disadvantageous because it has sometimes deteriorated with time and because it has sometimes provided an output at inappropriate times to actuate the output unit. These problems have occurred because the timing unit has been chemical. Such problems have been known to exist in the timing systems of the prior art for a relatively long period of time without any real ability to minimize the problems specified in this paragraph.

The output mechanism actuated by the timing and firing unit may have a number of different forms, all known in the prior art. For example, the output mechanism may constitute a cutter for a reefing line or may provide heat from a thermal battery. Generally, the input and output mechanisms have been more advanced in the prior art than the timing and firing unit.

There is another disadvantage to the timing and firing systems now in use. This results from the fact that these systems require self-contained batteries. These batteries deteriorate with time. As a result, the batteries limit the lifetimes of the systems and can lead to unpredictable failures. The batteries are relatively heavy and add considerable weight to the timing and firing systems. Attempts have been made in the past to provide systems which eliminate the need for batteries but such attempts have not been successful.

This invention provides a timing and firing system which overcomes the disadvantages specified above. The timing and firing system operates without any battery or other external source of energy, the system deriving its energy from an electrical pulse from an input mechanism. The system operates to provide an adjustable and pre-selected delay between the input pulse and the actuation of an output mechanism. This time delay is quite precise, even when the system has been stored for a considerable period of time, even years, without use. The system can be used with a wide variety of input and output mechanisms.

In one embodiment of the invention, an input electrical pulse as from an input mechanism is rectified and converted to a direct voltage which may be regulated in magnitude. The regulated direct voltage may be introduced to a timing circuit which produces a signal after an adjustable and pre-selected delay. This signal causes a circuit to produce a triggering signal. The circuit is biased by a capacitor charged by the direct voltage so that it produces the triggering signal only after the timing circuit has provided the pre-selected delay. The triggering signal closes a switch (e.g. makes a transistor conductive) which provides a low impedance to a firing device such as a squib. The direct voltage then activates the firing device and the firing device actuates an output mechanism.

The input mechanism may be coupled to a housing at one position in the housing. When actuated, the input mechanism introduces the input pulse to the circuitry described above, such circuitry being disposed in the housing. The firing device then actuates the output mechanism, which is coupled to the housing at a second position in the housing, such second position preferably being oppositely disposed from the first position. The housing may be constructed to prevent radio frequency signals external to the housing from interfering with the operation of the circuitry in the housing.

Figure 2:
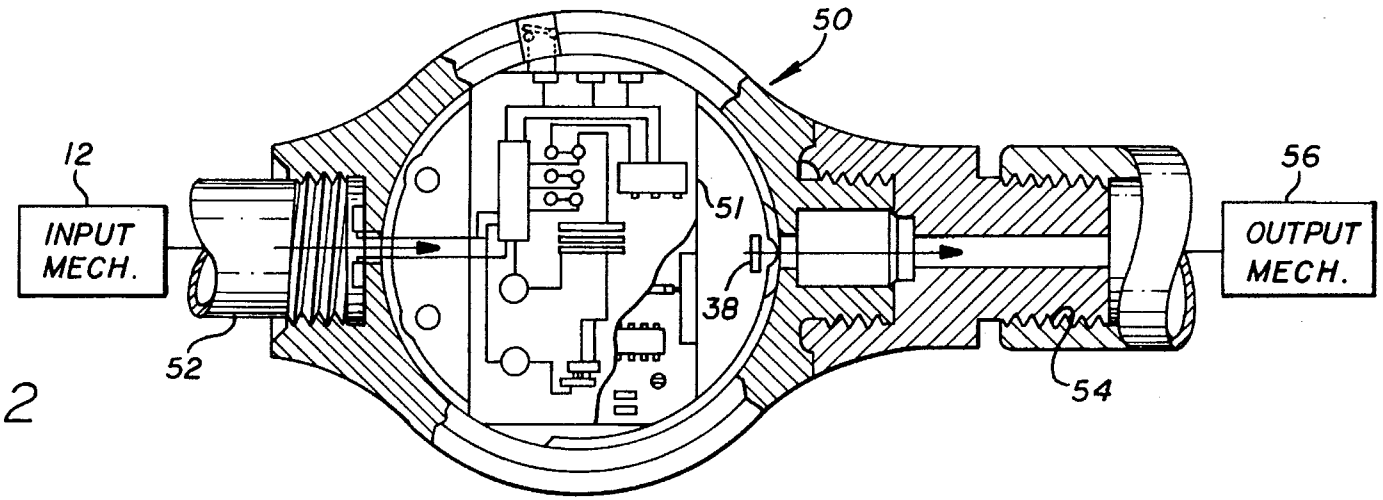

In the drawings:

FIG. 1 is a circuit diagram, partly in block form, of a timing and firing system for actuating an output mechanism in accordance with the introduction of an input pulse to the system from an input mechanism; and FIG. 2 is an elevational view of a housing for the timing and firing system shown in FIG. 1 and for the associated input and output mechanisms.

In one embodiment of the invention, a system generally indicated at 10 is shown in FIG. 1. The system includes an input mechanism 12 for producing an input electrical pulse. The pulse may illustratively have an amplitude such as approximately five amperes (5 A.) and may have a suitable duration such as approximately ten milliseconds (10 ms.). The energy of the pulse may accordingly be approximately five milliampere-seconds or approximately five million ergs.

The input pulse from the input mechanism 12 is passed through a diode 14 to an ungrounded terminal of a capacitor 16. The other terminal of the capacitor 16 and one terminal of the input mechanism 12 are connected to a reference potential such as ground. A resistor 18 and a zener diode 20 may be in series with each other and in parallel with the capacitor 16. The terminal common to the resistor 18 and the zener diode 20 has a common connection with a terminal in a timing circuit 22. The terminal provides a voltage $V_{DD}$ for energizing the timing circuit. The terminal common to the resistor 18 and the zener diode 20 also has a common connection with another terminal in the timing circuit 22. This terminal is connected in the timing circuit 22 to institute the timing of an adjustable and pre-selected time period. Another terminal of the timing circuit 22 may be grounded. The timing circuit 22 may be constructed in a conventional manner and may be illustratively purchased from the Timex Corporation.

A fourth terminal of the timing circuit 22 may be connected to the gate of a transistor 24 which may be a CMOS transistor of the n type. A resistor 26 may be connected between the source of the transistor 24 and the reference potential such as ground. The drain of the transistor 24 may have a common connection with a terminal common to a resistor 28 and a capacitor 30. The other terminal of the resistor 28 is connected to the ungrounded terminal of the resistor 18 and the other terminal of the capacitor 30 is connected to the reference potential such as ground.

The gate of a transistor 32 receives the voltage on the terminal common to the resistor 28 and the capacitor 30. The transistor 32 may be a CMOS transistor of the p-type. The voltage on the ungrounded terminal of the capacitor 16 is applied to the source of the transistor 32. The drain of the transistor 32 is common with the gate of a transistor 36, the source of which is common with the reference potential such as ground. The drain of the transistor 36 is also common with one terminal of a firing device such as a squib 38. The other terminal of the squib 38 receives the voltage on the ungrounded terminal of the capacitor 16.

When the input mechanism 12 is actuated, it produces a pulse having a positive amplitude such as approximately five amperes (5 A) and a duration such as approximately five milliseconds (5 ms). This pulse is rectified by the diode 14 and is introduced to the capacitor 16 to charge the capacitor. The capacitor 16 accordingly produces a positive direct voltage. This direct voltage may be regulated at a maximum value as by the zener diode 20 and the regulated voltage is introduced as the $V_{DD}$ voltage to the timing circuit 22 and also to the terminal in the timing circuit for initiating a timing of a pre-selected and adjustable period.

The timing circuit 22 may be constructed in a conventional manner. For example, the timing circuit 22 may be purchased as a commercial item from the Timex Corporation. The timing circuit 22 may be adjusted to provide any preselected time delay, this time delay being initiated by the application of the $V_{DD}$ voltage to the timing circuit and to the start terminal in the timing circuit. At the end of this pre-selected delay, the timing circuit introduces a signal to the gate of the transistor 24 to trigger the transistor to a state of conductivity.

When the transistor 24 becomes conductive, current flows through a circuit including the capacitor 16, the resistor 28, the transistor 24 and the resistor 26. The resultant voltage drop across the resistor 28 biases the transistor 32 to a state of conductivity. Until the voltage drop across the resistor 28 as a result of the current through the transistor 24, the transistor 32 is biased to a state of non-conductivity by the charge produced in the capacitor 30.

Current flows through a circuit including the capacitor 16, the transistor 32 and the resistor 34 when the transistor 24 becomes conductive. The resultant voltage drop across the resistor 34 is introduced to the base of the transistor 36 to make the transistor conductive. A current path is accordingly provided through a circuit including the capacitor 16, the firing device 38 and the transistor 36. The current through the firing device 38 causes the firing device 38 to become activated.

The input pulse from the input mechanism 12 provides an energy of approximately five million (5M) ergs. Energy is absorbed by the capacitor 16. The efficiency of this energy absorption may be approximately sixty percent (60%). This causes the capacitor 16 to store approximately three million (3M.) ergs. The timing circuit 22 requires less than one million (1M.) ergs to operate for approximately one thousand seconds (1000 sec.). The firing device 38 requires approximately five hundred (500) ergs to become activated. Since two million (2M.) ergs are available to the circuits including the transistors 24, 32 and 36, there is a considerable margin of error to activate the firing device 38.

The components comprising the system 10 may be included in a printed circuit board 51 which is disposed in housing generally indicated at 50. The housing 50 may be constructed to provide a continuous Faraday shield which protects the system 10 from the hazards of radio frequencies. The housing 50 may be provided with a first fitting such as a projection 52 which is internally threaded. The input mechanism 12 may be constructed to be screwed into the fitting 52. The housing 50 may also be provided with a second fitting 54 which is preferably disposed opposite the first fitting. The second fitting may be externally threaded. An output mechanism 56 may be screwed on the threaded projection 54. The output mechanism 56 communicates with the firing device 38. In this way, when the firing device 38 is activated, it actuates the output mechanism 56. The firing device 38 may be disposed on the board 51 or it may be displaced in the housing 50 from the board.

The system 10 has certain important advantages. The system 10 is quite miniaturized so that it can be contained within the housing 50 which may be provided with a pancake configuration having a diameter of less than one inch (1"). The system 10 derives its energy entirely from the input pulse produced by the input mechanism 10. This energy is utilized to operate the timing circuit 22 which may be digital. After 16 a pre-selected delay adjustable in the timing circuit 22, the energy from the input pulse is used to activate the firing device 38. The firing device then actuates the output mechanism 56.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination in a system which receives energy only from an input pulse, first means for providing the input electrical pulse, second means responsive only to the input electrical pulse for converting the energy in the input pulse to a direct voltage, third means responsive only to the production of the direct voltage during the production of the input pulse for initiating a particular delay in time and for producing a pulse after the particular delay in time, a firing mechanism, and fourth means responsive to the direct voltage and to the pulse from the third means for firing the firing mechanism.

2. In a combination as set forth in claim 1, fifth means for regulating the direct voltage introduced to the third means.

3. In a combination as set forth in claim 1, fifth means for providing for the firing of the firing mechanism only upon the production of the pulse by the third means.

4. In a combination as set forth in claim 1, fifth means responsive to the input pulse for biasing the third means to obtain a firing of the firing mechanism only upon the production of the pulse by the third means.

5. In combination in a system which receives energy only from an input pulse, first means for providing an input pulse, first means for providing the input pulse, means for rectifying the input pulse, second means, including a capacitor, responsive only to the rectified input pulse for producing a direct voltage in the capacitor, timing means responsive only to the direct voltage in the capacitor for initiating a timing period and for producing a pulse at the end of the timing period, output means, and third means responsive to the direct voltage in the capacitor and the pulse from the timing means for activating the output means.

6. In a combination as set forth in claim 5, the third means including fourth means responsive to the direct voltage in the capacitor for biasing the output means to provide for the activation of the output means only upon the production of the pulse by the timing means.

7. In a combination as set forth in claim 5, the third means including a first stage responsive to the pulse from the timing means to produce a signal and including a second stage biased by the charge in the capacitor to prevent the activation of the output means and responsive to the signal from the first stage to activate the output means even with the bias provided by the second stage.

8. In a combination as set forth in claim 7, fourth means for regulating the direct voltage introduced to the timing means.

9. In combination in a system which receives energy only from an input pulse, first means for providing the input pulse, second means for rectifying the input pulse, third means, including a capacitor, responsive only to the input pulse for producing a charge in the capacitor, fourth means responsive only to the charge in the capacitor for initiating a pre-selected timing period, fifth means operative at the end of the pre-selected timing period for producing a triggering signal, output means, sixth means responsive to the triggering signal and to the charge in the capacitor for activating the output means, and seventh means responsive to the charge in the capacitor for biasing the sixth means to provide for the activation of the output means only upon the production of the triggering signal by the fifth means.

10. In a combination as set forth in claim 9, the capacitor constituting a first capacitor, the sixth means including a transistor having conductive and non-conductive stales and responsive to the triggering signal to become conductive and responsive to the charge in the capacitor to produce a current through the output means for activating the output means, and the seventh means including a second capacitor responsive to the charge in the capacitor for biasing the transistor to a state of nonconductivity until the production of the triggering signal.

11. In a combination as set forth in claim 10, the third means including eighth means for regulating the operation of the fourth means in initiating the pre-selected timing period.

12. In a combination as set forth in claim 11, the third means including a first resistor in parallel with the first capacitor and the seventh means including a second resistor in series with the second capacitor.

13. In combination in a system which receives energy only from an input voltage, output means, first means for providing the input pulse, second means, including a capacitor, responsive only to the input pulse for producing a direct voltage in the capacitor, third means responsive only to the production of the direct voltage in the capacitor for producing a signal after a delay of a particular period, and fourth means responsive only to the signal from the third means and the direct voltage in the capacitor for producing a triggering signal for activating the output means.

14. In a combination as set forth in claim 13, the second means including rectifying means and further including means for regulating the direct voltage in the capacitor.

15. In a combination as set forth in claim 13, the fourth means including fifth means responsive to the direct voltage in the capacitor for biasing the fourth means against the production of the triggering signal except upon the production of the signal from the third means.

16. In a combination as recited in claim 15, sixth means coupled to the output means for providing an open circuit to prevent the output means from being activated, the fourth means being coupled to the sixth means for closing the open circuit in the sixth means to obtain the activation of the output means.

17. In combination in a system which receives energy only from an input voltage, an input mechanism, an output mechanism, a housing having a first fitting for receiving the input mechanism and a second fitting for receiving the output mechanism, the input mechanism being constructed to produce the input electrical pulse when actuated, first means disposed in the housing and including a capacitor and responsive only to the input voltage for converting the input voltage to a direct voltage in the capacitor, second means disposed in the housing and responsive only to the direct voltage in the capacitor for producing a triggering signal after a particular delay, a firing device disposed in the housing relative to the output mechanism for actuating the output mechanism when activated, and third means disposed in the housing and responsive to the direct voltage in the capacitor and to the triggering signal from the second means for activating the firing device.

18. In a combination as set forth in claim 17, the housing being constructed to prevent radio frequency energy external to the housing from entering into the housing.

19. In a combination as set forth in claim 17, fourth means disposed in the housing and responsive to the direct voltage in the capacitor and coupled to the third means for providing for the activation of the firing device only upon the production of the triggering signal.

20. In a combination as set forth in claim 17, fourth means for applying the direct voltage in the capacitor to the firing device to activate the firing device upon the production of the triggering signal.

21. In a combination as set forth in claim 20, the housing being constructed to prevent radio frequency energy external to the housing from entering into the housing, and fifth means disposed in the housing and responsive to the direct voltage in the capacitor and coupled to the third means for providing for the activation of the firing device by the third means only upon the production of the triggering signal.

22. In a combination as set forth in claim 21, sixth means for regulating the direct voltage produced in the capacitor.

* * * * *